US008470237B2

(12) United States Patent
Hiraide et al.

(10) Patent No.: US 8,470,237 B2
(45) Date of Patent: Jun. 25, 2013

(54) STAINLESS STEEL EXCELLENT IN CORROSION RESISTANCE, FERRITIC STAINLESS STEEL EXCELLENT IN RESISTANCE TO CREVICE CORROSION AND FORMABILITY, AND FERRITIC STAINLESS STEEL EXCELLENT IN RESISTANCE TO CREVICE CORROSION

(75) Inventors: Nobuhiko Hiraide, Shuunan (JP); Haruhiko Kajimura, Hikari (JP); Ken Kimura, Futtsu (JP)

(73) Assignee: Nippon Steel & Sumikin Stainless Steel Corporation, Tokyo (JP)

( * ) Notice: Subject to any disclaimer, the term of this patent is extended or adjusted under 35 U.S.C. 154(b) by 351 days.

(21) Appl. No.: 12/226,592

(22) PCT Filed: May 8, 2007

(86) PCT No.: PCT/JP2007/059501

§ 371 (c)(1),
(2), (4) Date: Oct. 21, 2008

(87) PCT Pub. No.: WO2007/129703

PCT Pub. Date: Nov. 15, 2007

(65) Prior Publication Data

US 2010/0150770 A1 Jun. 17, 2010

(30) Foreign Application Priority Data

May 9, 2006 (JP) ..... 2006-130172
Aug. 3, 2006 (JP) ..... 2006-212115
Aug. 8, 2006 (JP) ..... 2006-215737
Feb. 6, 2007 (JP) ..... 2007-026328

(51) Int. Cl.

*C22C 38/32* (2006.01)
*C22C 38/60* (2006.01)
*C22C 38/22* (2006.01)
*C22C 38/28* (2006.01)
*C22C 38/18* (2006.01)

(52) U.S. Cl.

USPC ..... 420/41; 420/61; 420/62; 420/64; 420/68; 420/70; 420/63; 420/60

(58) Field of Classification Search

USPC ..... 148/325, 326; 420/41, 67, 68, 69, 420/70, 60–64

See application file for complete search history.

(56) References Cited

U.S. PATENT DOCUMENTS

| | | | | |
|---|---|---|---|---|
| 4,155,752 | A | 5/1979 | Oppenheim et al. | |
| 4,461,811 | A | 7/1984 | Borneman | |
| 5,405,575 | A | 4/1995 | Yazawa et al. | |
| 5,413,754 | A | 5/1995 | Yazawa et al. | |
| 5,512,239 | A | 4/1996 | Fujiwara et al. | |
| 6,679,954 | B1 | 1/2004 | Takano et al. | |
| 6,730,407 | B2 * | 5/2004 | Mori et al. | 428/425.8 |
| 7,732,733 | B2 * | 6/2010 | Kobayashi et al. | 219/146.1 |
| 2002/0136661 | A1 | 9/2002 | Yazawa et al. | |
| 2003/0183626 | A1 | 10/2003 | Tomimura et al. | |
| 2003/0196715 | A1 | 10/2003 | Sakamoto et al. | |
| 2004/0055674 | A1 * | 3/2004 | Yazawa et al. | 148/610 |
| 2004/0084116 | A1 | 5/2004 | Oku et al. | |
| 2004/0159380 | A1 * | 8/2004 | Yazawa et al. | 148/610 |
| 2010/0272594 | A1 | 10/2010 | Hiraide | |

FOREIGN PATENT DOCUMENTS

| | | | |
|---|---|---|---|
| CN | 1524130 | | 8/2004 |
| CN | 1572895 | | 2/2005 |
| CN | 1715437 | | 1/2006 |
| CN | 1788102 | | 6/2006 |
| CN | 101255532 | | 9/2008 |
| EP | 1 683 885 | | 7/2006 |
| GB | 1577783 | | 10/1980 |
| JP | 53-089816 | | 8/1978 |
| JP | S55-138058 | | 10/1980 |
| JP | 57-060056 | | 4/1982 |
| JP | 01-249294 | | 10/1989 |
| JP | 06-002046 | * | 1/1994 |
| JP | 6-172935 | | 6/1994 |
| JP | 7-34205 | | 2/1995 |
| JP | 7-292446 | | 11/1995 |
| JP | 09-041103 | * | 2/1997 |
| JP | 09-174114 | | 7/1997 |
| JP | 2880906 | | 1/1999 |

(Continued)

OTHER PUBLICATIONS

English translation of JP 06-002046, Minamino et al, published Jan. 11, 1994, 14 pages.*

International Search Report dated Jan. 26, 2010 issued in PCT Application No. PCT/JP2009/005607 corresponding to U.S. Application No. 12/998,242.

Non-Final Office Action dated Mar. 29, 2012, issued in U.S. Application No. 12/998,242.

Final Office Action dated Aug. 28, 2012, issued in U.S. Application No. 12/998,242.

Chinese Office Action, dated May 29, 2012, issued in corresponding Chinese Application No. 200980133326.9, with an English translation thereof.

Japanese Notice of Allowance, dated Jul. 10, 2012, issued in corresponding Japanese Application No. 2006-212115, with an English translation thereof.

(Continued)

*Primary Examiner* — Jessee R. Roe

(74) *Attorney, Agent, or Firm* — Kenyon & Kenyon LLP

(57) ABSTRACT

The stainless steel of the first embodiment includes C: 0.001 to 0.02%, N: 0.001 to 0.02%, Si: 0.01 to 0.5%, Mn: 0.05 to 0.5%, P: 0.04% or less, S: 0.01% or less, Ni: more than 3% to 5%, Cr: 11 to 26%, and either one or both of Ti: 0.01 to 0.5% and Nb: 0.02 to 0.6%, and contains as the remainder, Fe and unavoidable impurities. The stainless steel of the second embodiment has an alloy composition different from those of the first and third embodiments and satisfies the formula (A): $Cr+3Mo+6Ni \geqq 23$ and formula (B): $Al/Nb \geqq 10$ and contains as the remainder, Fe and unavoidable impurities. The stainless steel of the third embodiment has an alloy composition different from those of the first and second embodiments and includes either one or both of Sn: 0.005 to 2% and Sb: 0.005 to 1% and contains as the remainder, Fe and unavoidable impurities.

4 Claims, 5 Drawing Sheets

FOREIGN PATENT DOCUMENTS

| | | | |
|---|---|---|---|
| JP | 11-092872 | * | 4/1999 |
| JP | 11-236654 | | 8/1999 |
| JP | 2000-073147 | | 3/2000 |
| JP | 2000-169943 | | 6/2000 |
| JP | 2000-297355 | | 10/2000 |
| JP | 2001-026855 | | 1/2001 |
| JP | 2001-288543 | | 10/2001 |
| JP | 2001-288544 | * | 10/2001 |
| JP | 2001-294991 | * | 10/2001 |
| JP | 2002-004011 | | 1/2002 |
| JP | 2002-285300 | | 10/2002 |
| JP | 2003-183781 | | 7/2003 |
| JP | 2003-193205 | | 7/2003 |
| JP | 2003-277992 | | 10/2003 |
| JP | 2003-328088 | | 11/2003 |
| JP | 3545759 | | 7/2004 |
| JP | 2004-277663 | | 10/2004 |
| JP | 2005-055153 | | 3/2005 |
| JP | 2005-89828 | | 4/2005 |
| JP | 2005-089850 | | 4/2005 |
| JP | 2005-146345 | * | 6/2005 |
| JP | 2005-220394 | | 8/2005 |
| JP | 2005-220429 | * | 8/2005 |
| JP | 2005-336599 | | 12/2005 |
| JP | 2006-052337 | | 2/2006 |
| JP | 2006-063323 | | 3/2006 |
| JP | 2006-257544 | | 9/2006 |
| JP | 2006-274391 | | 10/2006 |
| JP | 2007-064515 | | 3/2007 |
| JP | 2007-224786 | | 9/2007 |
| JP | 2008-096048 | | 4/2008 |
| JP | 2008-195985 | | 8/2008 |
| JP | 2009-120893 | | 6/2009 |
| JP | 2009-120894 | | 6/2009 |
| JP | 2009-174040 | | 8/2009 |
| JP | 2009-174046 | | 8/2009 |
| KR | 10-2002-0062202 | | 7/2002 |
| RU | 2270269 | | 2/2006 |

OTHER PUBLICATIONS

International Search Report dated Aug. 14, 2007 issued in corresponding PCT Application No. PCT/JP2007/059501.

Korean Office Action dated Jul. 7, 2011 issued in corresponding KR Application No. 10-2008-7027083.

Notification of Acceptance of Request for Invalidation dated Oct. 8, 2011 issued in corresponding Chinese Application No. 200780016464.X [with English Translation].

Korean Notice of Allowance dated Nov. 21, 2011 issued in corresponding Korean Application No. 10-2011-7000667 [with English Translation].

Lu et al., "Stainless Steels", special steel series, Atomic Energy Press, Beijing, Sep. 31, 1995 [with Partial English Translation].

Canadian Office Action dated Jan. 11, 2012, issued in corresponding Canadian Application No. 2,650,469.

Japanese Information Statement, dated Nov. 20, 2012, issued in Japanese application No. 2009-241500 corresponding to U.S. Appl. No. 12/998,242, with an English translation thereof.

U.S. Office Action, dated Mar. 1, 2013, issued in U.S. Appl. No. 12/998,242.

Chinese Office Action dated Apr. 11, 2013, issued in corresponding Chinese Application No. 200980133326.9.

* cited by examiner

STAINLESS STEEL EXCELLENT IN CORROSION RESISTANCE, FERRITIC STAINLESS STEEL EXCELLENT IN RESISTANCE TO CREVICE CORROSION AND FORMABILITY, AND FERRITIC STAINLESS STEEL EXCELLENT IN RESISTANCE TO CREVICE CORROSION

TECHNICAL FIELD

The first embodiment of the present invention relates to a stainless steel that can be employed in salt-induced corrosion environments where superior corrosion resistance is required. For example, the first embodiment of the present invention relates to a stainless steel that can be employed in building materials or outside equipments used in marine environments where there is ubiquitous airborne salt, or in components such as fuel tanks and fuel pipes of automobiles and two-wheeled vehicles which travel over cold regions where antifreezing agents are spread in winter.

The second embodiment of the present invention relates to a ferritic stainless steel that can be employed in components that demand superior resistance to crevice corrosion and formability, such as equipments and pipings that have crevice portions in their design, for example, exhausts system components and fuel system components for automobiles and two-wheeled vehicles, hot water supply equipments, and the like.

The third embodiment of the present invention relates to a ferritic stainless steel that can be employed in components that demand superior resistance to crevice corrosion, such as equipments and pipings that have crevice portions in their design and are used in chloride environments, for example, automobile components, water or hot water supply equipments, building equipments, and the like.

This application claims priority from Japanese Patent Application No. 2006-130172 filed on May 9, 2006, Japanese Patent Application No. 2006-212115 filed on Aug. 3, 2006, Japanese Patent Application No. 2006-215737 filed on Aug. 8, 2006, and Japanese Patent Application No. 2007-26328 filed on Feb. 6, 2007, the contents of which are incorporated herein by reference.

BACKGROUND ART

Stainless steel has been used in various applications in recent years, exploiting its excellent corrosion resistance. Local corrosions such as pitting corrosion, crevice corrosion, and stress corrosion cracking are particularly important with regard to the corrosion resistance of components such as stainless steel devices or pipes, and there is a problem that these give rise to penetration holes through which internal fluids can leak.

In marine environments, airborne salt which includes a large amount of seawater components is the corrosive element. In cold regions, chlorides contained in antifreezing agents which are spread in winter are the corrosive element. Sodium chloride and magnesium chloride are present as chlorides contained in seawater. These chlorides become adhered as an airborne salt component. When they then become wet, they readily form concentrated chloride solutions. Meanwhile, antifreezing agents are formed of calcium chloride and sodium chloride, and since they are typically applied in a solid state, they readily form a concentrated chloride solution. Among the chlorides varieties, sodium chloride dries at a relative humidity of 75% or less, while magnesium chloride and calcium chloride will not dry until the relative humidity reaches 40% or less. As a result, magnesium chloride and calcium chloride form concentrated chloride solutions over a wider humidity range. This also expresses the extent of deliquescence, showing that magnesium chloride and calcium chloride absorb moisture at a lower humidity to form a concentrated chloride solution, compared with sodium chloride. Since the relative humidity is typically in the range of 40 to 75% in ambient air, it is extremely important to have a superior corrosion resistance in the presence of concentrated magnesium chloride or concentrated calcium chloride.

Patent Document 1 discloses a ferritic stainless steel with improved resistance to crevice corrosion. The invention disclosed in this specification is characterized in obtaining superior resistance to crevice corrosion by adding a mixture of 16% or more of Cr and about 1% of Ni, without requiring a large addition of Cr or Mo. In this Patent Document 1, evaluation was carried out using a repeated drying and wetting test in a sodium chloride environment. By employing a repeated drying and wetting test, the corrosion characteristics of the disclosed ferritic stainless steel in a concentrated sodium chloride solution can be ascertained; however, no consideration is given to the corrosion properties in a solution of concentrated magnesium chloride or concentrated calcium chloride.

Patent Document 2 discloses a ferritic stainless steel which can be used in marine environments due to the addition of a large amount of Cr and Mo, and a suitable amount of Co. However, Co and Mo are expensive and manufacturability is impaired with the addition of large amounts of Cr, Mo, and Co. Patent Document 3 discloses a ferritic stainless steel in which corrosion resistance is improved by the addition of P, and therefore, large amounts of Cr and Mo are not required. Furthermore, by optimizing amounts of C, Mn, Mo, Ni, Ti, Nb, Cu and N, manufacturability can be assured. However, since P causes a deterioration in welding properties, this is a hindrance when manufacturing welded structures. Further, the most severe test of corrosion resistance that is disclosed in Patent Document 3 is the CASS test (sodium chloride solution spray test), and no consideration is given to concentrated magnesium chloride or concentrated calcium chloride environments. Patent Document 4 discloses a ferritic stainless steel in which corrosion resistance is increased by the addition of P, and the improvement of cleanness and the control of configuration of inclusions are aimed to be attained by adding suitable amounts of Ca and Al. This Patent Document 4 also discloses selective addition of Mo, Cu, Ni, Co and the like. Here, the most severe corrosion test is a crevice corrosion generating test conducted in 10% ferric chloride-3% sodium chloride solution, and no consideration is given to concentrated magnesium chloride or concentrated calcium chloride environments.

Austenitic stainless steel typified by SUS304 and SUS316L has excellent resistance to penetration hole formation caused by pitting corrosion or crevice corrosion, but there is concern with respect to its resistance to stress corrosion cracking. Accordingly, so-called "super" austenitic stainless steel which includes high-Cr, high-Ni, and high-Mo to suppress the occurrences of the pitting corrosion and the crevice corrosion that are the causes of the stress corrosion cracking may be considered to be employed, or SUS315J1, 315J2 type steels in which stress corrosion cracking is improved by combined addition of Si and Cu may be considered to be employed. However, both of these approaches are expensive.

Ferritic stainless steel has come to be used in various applications in recent years due to its corrosion resistance, formability, and cost performance. Local corrosions such as pitting corrosion, crevice corrosion, and stress corrosion cracking are particularly important with respect to durability of stainless steel equipments and pipings. For ferritic stainless steels, pitting corrosion and crevice corrosion are particularly important. In the case of components where crevice portions are present in the design at welded sites, flange attachment sites, and the like, crevice corrosion is particularly important, and there is a problem that this crevice corrosion gives rise to penetration holes through which internal fluids may leak. For example, in the case of automobiles, there is a move to extend the guarantee period from 10 to 15 years for essential parts such as fuel tanks, fuel supply lines, and the like, and therefore, there is a need to ensure reliability over a long period of time.

Further, local corrosions as described above are also important for the durability of stainless steel equipments and piping components which are employed in chloride environments.

In order to prevent penetration holes due to crevice corrosion, and damage due to stress corrosion cracking arising from crevice corrosion, Patent Documents 5 and 6 disclose counter measures using coating and sacrificial corrosion protection.

In the case of coatings, there is a large burden on the environmental measures since solvents and the like are used in the pre-treatment process. Further, in the case of sacrificial corrosion protection, there is a problem where maintenance costs are expensive. Therefore, it is desirable to ensure resistance to crevice corrosion in an untreated state without relying on coating or sacrificial corrosion protection. Employment of a ferritic stainless steel in which corrosion resistance is improved by adding large amounts of Cr and Mo may be considered as one approach. However, steels which include high-Cr and high-Mo have a problem that formability is inferior and, moreover, are expensive. Therefore, a material which has both of corrosion resistance and formability without the addition of a large amount of an expensive element such as Mo has been desired.

improved by the addition of Ni, and discloses the selective addition of Mo and Cu for the purpose of further improving resistance to crevice corrosion. Because Ni decreases formability, there is a problem that it becomes difficult to form components where a high degree of formability is required, such as exhaust components or fuel system components of automobiles.

With regard to ferritic stainless steels containing Sn and Sb, a ferritic stainless steel plate having excellent high temperature strength is disclosed in Patent Document 8, while a ferritic stainless steel having excellent surface properties and corrosion resistance, and a method for manufacturing the ferritic stainless steel are disclosed in Patent Documents 9 and 10. In Patent Document 8, improvement in high temperature strength, and, in particular, a prevention of a deterioration in high temperature strength after long time aging is raised as the effect of Sn. Similar attributes are ascribed to Sb. The effect in the present invention is an effect to the resistance to crevice corrosion, and differs from the effects of Sn and Sb in Patent Document 8. In contrast, Patent Documents 9 and 10 are characterized in employing Mg and Ca as bases, adding Ti, C, N, P, S and O, and then controlling the contained amounts of these elements to improve ridging characteristics and corrosion resistance. Sn is disclosed as a selectively added element. Improvement of corrosion resistance is raised as the effect of Sn, and the corrosion resistance is evaluated using pitting potentials in the examples. The pitting potential electrochemically evaluates resistance with respect to the generation of pitting corrosion. In contrast, crevice corrosion is the subject of study in the present invention. As will be explained below, one aspect of the present invention uncovers, as the efficacy of Sn, an effect of limiting progression after the generation of crevice corrosion, and is different from the effect of improving resistance to the generation of pitting corrosion which is disclosed in
Patent Documents 9 and 10.

| | |
|---|---|
| Patent Document 1: | Japanese Patent Application, First Publication No. 2005-89828 |
| Patent Document 2: | Japanese Patent Application, First Publication No. S55-138058 |
| Patent Document 3: | Japanese Patent Application, First Publication No. H6-172935 |
| Patent Document 4: | Japanese Patent Application, First Publication No. H7-34205 |
| Patent Document 5: | Japanese Patent Application, First Publication No. 2003-277992 |
| Patent Document 6: | Japanese Patent No. 3545759 |
| Patent Document 7: | Japanese Patent No. 2880906 |
| Patent Document 8: | Japanese Patent Application, First Publication No. 2000-169943 |
| Patent Document 9: | Japanese Patent Application, First Publication No. 2001-288543 |
| Patent Document 10: | Japanese Patent Application, First Publication No. 2001-288544 |

Patent Document 7 discloses a ferritic stainless steel in which corrosion resistance is increased by the addition of P, and the improvement of cleanness and the control of configuration of inclusions are aimed to be attained by adding suitable amounts of Ca and Al. This Patent Document 7 further discloses the selective addition of Mo, Cu, Ni, Co and the like. However, the P causes a deterioration in welding properties, and is thus a hindrance when manufacturing welded structures. Further, costs rise due to the deterioration in manufacturability. Further, while suitable amounts of Ca and Al may be added to augment the decline in formability due to P, the suitable range is narrow, and production costs increase. Therefore, the ferritic stainless steel becomes expensive, and the merit of employing ferritic stainless steel is diminished due to its high cost as a material.

The above described Patent Document 1 discloses a ferritic stainless steel in which resistance to crevice corrosion is

DISCLOSURE OF THE INVENTION

Problems to be Solved by the Invention

It is the first object of the present invention to provide a stainless steel having superior resistance to penetration hole formation arising from crevice corrosion and pitting corrosion, as well as superior resistance to stress corrosion cracking (stress corrosion cracking resistance) without adding a large amount of expensive Ni and Mo, in salt-induced corrosion environments such as a marine environment and a road environment in cold regions where antifreezing agents are spread, in particular, even in such salt-induced corrosion environments as typified by highly concentrated magnesium chloride or highly concentrated calcium chloride, which are more severely corrosive environments than that of the sodium chloride environment that was the technical subject of the prior art.

It is the second object of the present invention to provide a ferritic stainless steel having superior resistance to penetration hole formation at crevice portions (resistance to crevice corrosion) as well as superior formability.

It is the third object of the present invention to provide a ferritic stainless steel having superior resistance to crevice corrosion, and particularly superior resistance to penetration hole formation at crevice portions.

Means to Resolve the Problem

The stainless steel excellent in corrosion resistance according to the first embodiment of the present invention includes, in terms of mass %, C: 0.001 to 0.02%, N: 0.001 to 0.02%, Si: 0.01 to 0.5%, Mn: 0.05 to 0.5%, P: 0.04% or less, S: 0.01% or less, Ni: more than 3% to 5%, and Cr: 11 to 26%, and further includes either one or both of Ti: 0.01 to 0.5% and Nb: 0.02 to 0.6%, and contains as the remainder, Fe and unavoidable impurities.

Instead of a portion of the Fe, it may include one or more selected from the group consisting of Mo, Cu, V, W, and Zr, within the amounts of Mo: 3.0% or less, Cu: 1.0% or less, V: 3.0% or less, W 5.0% or less, and Zr: 0.5% or less.

It may further include one or more selected from the group consisting of Al: 1% or less, Ca: 0.002% or less, Mg: 0.002% or less, and B: 0.005% or less.

In the stainless steel that satisfies the above features, the combined ratio of austenite phase and martensite phase may be 15% or less, ferrite phase may be included as the remainder, and the grain size number of the ferrite phase may be No. 4 or greater.

In the second embodiment of the present invention, resistance to crevice corrosion is improved by the addition of Ni, and formability, which is negatively impacted by the Ni, is secured by the addition of a suitable amount of Al and the optimization of the Al/Nb ratio. Thereby, a ferritic stainless steel is provided that attains both of superior formability and excellent resistance to penetration hole formation at crevice portions (resistance to crevice corrosion).

The ferritic stainless steel excellent in resistance to crevice corrosion and formability according to the second embodiment of the present invention includes, in terms of mass %, C: 0.001 to 0.02%, N: 0.001 to 0.02%, Si: 0.01 to 1%, Mn: 0.05 to 1%, P: 0.04% or less, S: 0.01% or less, Ni: 0.15 to 3%, Cr: 11 to 22%, Mo: 0.5 to 3%, Ti: 0.01 to 0.5%, Nb: less than 0.08%, and Al: more than 0.1% to 1%, and contains as the remainder, Fe and unavoidable impurities, wherein the amounts of Cr, Ni, Mo and Al satisfy the following Formulas (A) and (B).

$$Cr+3Mo+6Ni \geqq 23 \quad (A)$$

$$Al/Nb \geqq 10 \quad (B)$$

It may further include either one or both of Cu: 0.1 to 1.5% and V: 0.02 to 3.0% at the amounts which satisfy the following formula (A').

$$Cr+3Mo+6(Ni+Cu+V) \geqq 23 \quad (A')$$

It may further include one or more selected from the group consisting of Ca: 0.0002 to 0.002%, Mg: 0.0002 to 0.002%, and B: 0.0002 to 0.005%.

In the third embodiment of the present invention, while considering the fact that by adding suitable amounts of Sn and Sb, resistance to crevice corrosion is improved and the duration until formation of penetration holes due to crevice corrosion is increased, a ferritic stainless steel excellent in resistance to crevice corrosion is provided based on the effect of the Sn and Sb on resistance to crevice corrosion, particularly, the effect on resistance to penetration hole formation at crevice portions.

The ferritic stainless steel excellent in resistance to crevice corrosion according to the third embodiment of the present invention includes, in terms of mass %, C: 0.001 to 0.02%, N: 0.001 to 0.02%, Si: 0.01 to 0.5%, Mn: 0.05 to 1%, P: 0.04% or less, S: 0.01% or less, and Cr: 12 to 25%, further includes either one or both of Ti and Nb within the amounts of Ti: 0.02 to 0.5% and Nb: 0.02 to 1%, further includes either one or both of Sn and Sb within the amounts of Sn: 0.005 to 2% and Sb: 0.005 to 1%, and contains as the remainder, Fe and undetectable impurities.

It may further include either one or both of Ni: 5% or less and Mo: 3% or less.

It may further include one or more selected from the group consisting of Cu: 1.5% or less, V: 3% or less, and W: 5% or less.

It may further include one or more selected from the group consisting of Al: 1% or less, Ca: 0.002% or less, Mg: 0.002% or less, and B: 0.005% or less.

Effects of the Invention

The first embodiment of the present invention has excellent resistance to penetration hole formation due to crevice corrosion and pitting corrosion as well as excellent resistance to stress corrosion cracking in salt-induced corrosion environments. As a result, this embodiment is effective in extending the lifespans of building materials and outside equipments in a marine environment where airborne salt is ubiquitous, as well as the lifespans of component parts such as fuel tanks, fuel pipes, and the like of automobiles and two-wheeled vehicles which travel over cold regions where antifreezing agents are spread in winter.

The second embodiment of the present invention can provide a ferritic stainless steel having both of excellent resistance to penetration hole formation at crevice portions (resistance to crevice corrosion) and superior formability. Thus, by employing the ferritic stainless steel having excellent resistance to crevice corrosion according to the second embodiment of the present invention for components such as exhaust system components and fuel system components of automobiles and two-wheeled vehicles, hot-water supply equipments, and the like where crevice portions are present in the design and crevice corrosion is problematic, their resistance to penetration hole formation can be improved; therefore, the embodiment has the effect of extending the lifespan of the components.

In particular, the ferritic stainless steel according to the embodiment is suitable as a material for important components such as fuel tanks and fuel supply pipes of automobiles where a long lifespan is required. Furthermore, since formability is excellent, this material is easily worked into a component, and is also suitable as a material for a manufactured part that is a steel pipe.

The third embodiment of the present invention can provide a ferritic stainless steel having excellent resistance to crevice corrosion, particularly excellent resistance to penetration hole formation at crevice portions. Thus, by employing the ferritic stainless steel having excellent resistance to crevice corrosion according to the third embodiment for components, among components used for automobile components, water and hot water supply equipments and building equipments, which have crevice portions in the design, and are used in chloride environments, and for which excellent resistance to crevice corrosion is required, their resistance to penetration hole formation at crevice portions can be improved. Therefore, the embodiment has the effect of extending the lifespan of the components. Here, examples of the automobile components include exhaust system components and fuel system components, such as exhaust pipes, mufflers, fuel tanks, tank fixing bands, feed oil pipes, and the like.

EXPLANATION OF THE SYMBOLS

1: spot welded part

Figure 1:
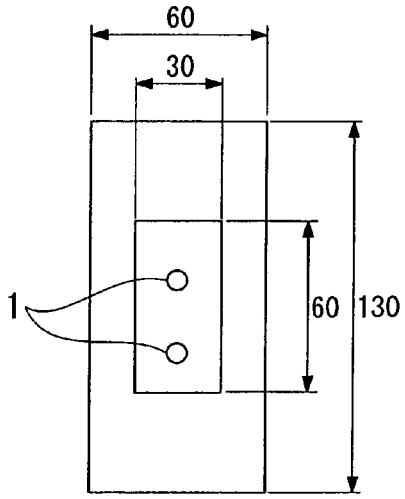
FIG. 1 shows the shape of the test piece.

Best Mode For Carrying Out The Invention (First Embodiment)

Corrosion progresses due to active dissolution at sites where local corrosions such as crevice corrosion and pitting corrosion occur. Austenitic stainless steel has a slow rate of dissolution, and therefore, a long time is required until a penetration hole forms due to dissolution at a corroded site. However, from the perspective of passivation that stops the dissolution, austenitic stainless steel is inferior to ferritic stainless. As a result, in austenitic stainless steel, active dissolution continues at a slow rate and susceptibility to stress corrosion cracking increases. In contrast, in ferritic stainless steel, since the active dissolution rate is high at sites where crevice corrosion or pitting corrosion occurs, the time until a penetration hole forms due to dissolution at a corroded site is short. On the other hand, susceptibility to stress corrosion cracking is low in ferritic stainless steel.

As discussed in the prior art, magnesium chloride and calcium chloride can exist as an aqueous solution at a lower relative humidity and have a higher saturation concentration as compared to sodium chloride. For this reason, since they can exist as a higher concentration chloride solution over a wider humidity range, they have a stronger corrosivity than sodium chloride. Thus, the active dissolution rate at the area where crevice corrosion or pitting corrosion occurs is increased, and stress corrosion cracking is promoted.

Rigorous research using ferrite stainless steel as the base was conducted for an alloying element that was effective at promoting passivation in order to reduce the active dissolution rate at areas where crevice corrosion or pitting corrosion occurs, and to improve susceptibility to stress corrosion cracking. As a result of these efforts, it was understood that Ni is the most useful element for reducing the rate of dissolution in the active state without impairing the passivation ability, and that it must be included in an amount in excess of 3% in order to provide a dissolution rate on par with austenitic stainless steel in a salt-induced corrosion environment typified by concentrated magnesium chloride or concentrated calcium chloride. Further, it was discovered that the martensite and austentite phases are generated as second phases when the Ni amount is increased, causing a deterioration in the passivation ability, and that when the ratio of the second phase is high, the steel becomes highly strong and has low ductility, and therefore, there is a marked deterioration in formability. It was further discovered that when the Ni amount is up to 5%, there is a decrease in the active dissolution rate, and the deteriorations in the passivation ability and in formability are within permissible limits. As a result, the present invention was attained.

The first embodiment of the present invention was conceived based on the above understandings. The chemical compositions prescribed in this invention will now be explained in further detail below.

C: Because it decreases intergranular corrosion resistance and formability, it is necessary to keep the amount of C at low level. However, if the amount is extremely reduced, refining costs rise. Thus, the amount of C is prescribed to be in the range of 0.001 to 0.02%, and the amount of C is preferably in the range of 0.002 to 0.015%, and is more preferably in the range of 0.002 to 0.01%.

N: N is a useful element with respect to resistance to pitting corrosion and crevice corrosion. However, it lowers formability and intergranular corrosion resistance. If the amount is extremely reduced, refining costs rise. Thus, the amount of N is prescribed to be in the range of 0.001 to 0.02%, and the amount of N is preferably in the range of 0.002 to 0.015%, and is more preferably in the range of 0.002 to 0.01%.

Si: Si is useful as a deoxidizing element, and is a useful element in corrosion resistance. However, since it reduces formability, its amount is limited to 0.01 to 0.5%. The amount is preferably in the range of 0.03 to 0.3%.

Mn: Mn is useful as a deoxidizing element. However, when Mn is included in excess, MnS is formed; thereby, it causes a deterioration in corrosion resistance. Therefore, its amount is limited to 0.05 to 0.5%.

P: Because it reduces welding properties and formability, it is necessary to keep the amount of P at low level. Thus, the amount of P is prescribed to be in the range of 0.04% or less.

S: When S is present as readily soluble sulfides such as CaS and MnS, it serves as a starting point for pitting corrosion or crevice corrosion, thus causing deteriorations in resistance to pitting corrosion and resistance to crevice corrosion. Thus, the amount of S is prescribed to be in the range of 0.01% or less. The amount is preferably 0.002% or less.

Cr: Cr is a fundamental element for ensuring corrosive resistance which is most important for a stainless steel, and also, Cr stabilizes the ferrite structure. Therefore, it is necessary to include Cr in an amount of at least 11% or more. While corrosion resistance improves as the amount of Cr is increased, formability and manufacturability decline.

Thus, the upper limit of the Cr amount is prescribed to be 26%. The amount is preferably in the range of 16 to 25%.

Ni: In corrosive environments such as calcium chloride and magnesium chloride that are more extremely corrosive than a sodium chloride environment, Ni suppresses the active dissolution rate at sites where crevice corrosion or pitting corrosion occurs. In addition, Ni is the most effective element with respect to passivation. Therefore, Ni is the most important element in the present invention. In order to express these effects, it is necessary to include Ni in an amount of at least more than 3%. However, when Ni is included in excess, formability deteriorates and costs rise. Accordingly, the upper limit of the Ni amount is prescribed to be 5%. The amount is preferably in the range of more than 3% to 4% or less, and is more preferably in the range of more than 3% to 3.5% or less.

Both of Ti and Nb fix C and N, and are useful elements from the perspective of improving formability and intergranular corrosion resistance at welded areas. The present invention includes either one or both of Ti and Nb.

Ti: Ti fixes C and N, and is a useful element from the perspective of improving formability and intergranular corrosion resistance at welded areas. It is necessary to include Ti in an amount of at least 0.01% or more. It is preferable to include Ti in an amount that is four-fold or greater than the sum of (C+N). However, when Ti is added in excess, Ti causes surface defects during manufacture, and leads to a deterioration in manufacturability. Thus, the upper limit of the Ti amount is set to be 0.5%. The amount is preferably in the range of 0.03 to 0.3%.

Nb: Nb fixes C and N, and is a useful element from the perspective of improving formability and intergranular corrosion resistance at welded areas. It is necessary to include Nb in an amount of at least 0.02% or more. It is preferable to include Nb in an amount which is eight-fold or greater than the sum of (C+N). In the case in which both of Ti and Nb are included, it is preferable to include Ti and Nb in amounts satisfying the relation that (Ti+Nb)/(C+N) is six or more. However, when Nb is added in excess, formability declines. Accordingly, an upper limit of the Nb amount is prescribed to be 0.6%. The amount is preferably in the range of 0.05 to 0.5%.

Mo: Mo may be included as necessary to ensure corrosion resistance. By adding Mo in combination with Ni, it is possible to suppress the active dissolution rate at areas where crevice corrosion or pitting corrosion occurs, and to increase the effect on passivation. Thus, corrosion resistance improves. Further, as in the case of Cr, Mo contributes to stabilization of the ferrite phase. Thus, if Mo is included, it is preferable to include Mo in an amount of 0.5% or more. However, when Mo is included in excess, Mo causes a deterioration in formability. Further, costs rise as Mo is expensive. Accordingly, if Mo is included, the amount is preferably in the range of 0.5 to 3.0%, and is more preferably in the range of 0.5 to 2.5%.

V, W, Zr: V, W, and Zr may be included as necessary to ensure corrosion resistance. By adding any of these in combination with Ni, it is possible to suppress the active dissolution rate at areas where crevice corrosion or pitting corrosion occurs, and to increase the effect on passivation. Thus, corrosion resistance improves. Further, V, W, and Zr contribute to stabilization of the ferrite phase. Thus, if at least any one of V, W, and Zr is included, it is preferable to add V in an amount of 0.02% or more, W in an amount of 0.5% or more, and Zr in an amount of 0.02% or more. However, when included in excess, V, W and Zr cause a deterioration in formability and lead to rising costs. Thus, the upper limits are set to be 3.0% for V, 5.0% for W, and 0.5% for Z.

Cu: Cu may be included as necessary to ensure corrosion resistance. By adding Cu in combination with Ni, it is possible to suppress the active dissolution rate at areas where crevice corrosion or pitting corrosion occurs, and to increase the effect on passivation. Thus, corrosion resistance improves. Thus, if Cu is included, it is preferable to include Cu in an amount of 0.1% or more. However, when Cu is included in excess, formability deteriorates. Further, since Cu is an austenite forming element, it is necessary to increase the amounts of Cr and Mo in order to stabilize the ferrite structure. Thus, costs rise. Accordingly, if Cu is included, the amount is preferably in the range of 0.1 to 1.0%, and is more preferably in the range of 0.2 to 0.6%.

Al, Ca, Mg: Al, Ca and Mg have deoxidizing effects, and are useful elements in refining. These may be included as needed. Further, Al, Ca and Mg are also useful for refining the structure, and improving formability and toughness. Therefore, it is preferable to include one or more of Al, Ca and Mg within the amounts of Al: 1% or less, Ca: 0.002% or less, and Mg: 0.002% or less. Among these, Al is a ferrite generating element, and has the effect of suppressing the formation of austenite phase at high temperatures. As a result, the texture of ferrite phase is formed; thereby, this effect is thought to contribute to an improvement in formability. Here, if Al is included, the amount is preferably in the range of 0.002% or more to 0.5% or less. If Ca or Mg is included, each amount is preferably in the range of 0.0002% or more.

B: B is an element useful for improving the secondary formability, and is preferably included in an amount of 0.0002% or more as needed. However, when included in excess, the primary formability deteriorates. Accordingly, the upper limit of the B amount may be prescribed to be 0.005%.

The properties in which the combined ratio of austenite phase and martensite phase is 15% or less, ferrite phase is included as the remainder, and the grain size number of the ferrite phase is No. 4 or greater: As the amount of Ni increases, second phases such as the austenite phase and the martensite phases become more readily present in addition to the ferrite phase. In the case of the present invention, since Cr, Ni and Mo are not added in large amounts, the martensite phase is more readily generated. When such a second phase is present, elongation at room temperature decreases, and therefore it is preferable to set the upper limit of the ratio of the second phases to be 15%. Further, if the temperature of the final annealing is increased in order to suppress the generation of the second phases, the ferrite phase becomes coarser, and the grain size number falls below No. 4. As a result, the decrease in the elongation at room temperature becomes remarkable. Accordingly, the grain size number is preferably in the range of No. 4 or greater. The properties in which the ratio of the second phases is 15% or less and the grain size number of the ferrite phase is No. 4 or greater are achieved by determining the Ni amount within the range of more than 3% to 5% that is prescribed in the present invention, to balance with the addition amounts of ferrite forming elements such as Cr and Mo and by setting the temperature of the final annealing, or by, for example, the methods disclosed in the Examples.

(Second Embodiment)

In devices and pipes having crevice portions in their design, such as exhaust system components and fuel system components of automobiles and two-wheeled vehicles, hot water supply equipments, and the like, the penetration hole formation (pitting) arising from crevice corrosion is an important factor determining the lifespan of the component. The present inventors extensively researched the process of penetration hole formation due to crevice corrosion, while dividing this process into an induction period up until crevice corrosion occurs, and a growth period after the occurrence of the crevice corrosion.

As a result, it became clear that in the case of ferritic stainless steel, the shortness of the latter period for corrosion growth is a major cause of shortening the duration until the penetration hole formation. Thus, it was understood that suppressing the growth rate of crevice corrosion is an important factor for improving the duration of resistance to penetration hole formation.

As a result of evaluating the impacts of various alloying elements, it was discovered that Ni is most effective for suppressing the growth rate of the crevice corrosion, and that the resistance to crevice corrosion is improved by setting the value of Cr+3Mo+6Ni to be 23 or more.

Figure 3:
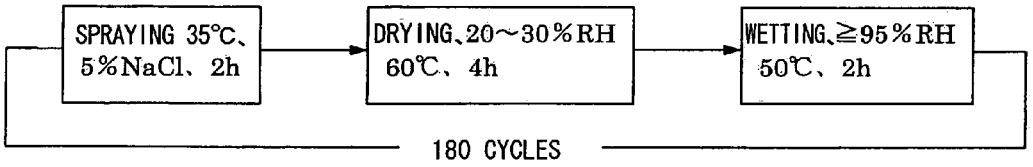
FIG. 3 shows the conditions for the repeated drying and wetting test in Example 2.
Figure 4:
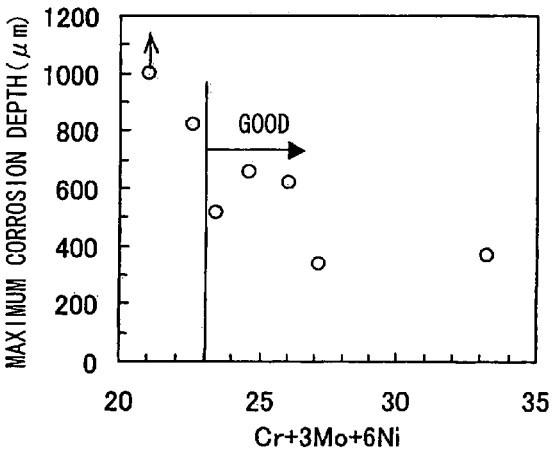
FIG. 4 shows the relationship between Formula (A) and the maximum corrosion depth.

Using a test piece formed by stacking a large test piece and a small test piece and spot-welding them at two points (the sites indicated by O in FIG. 1), tests were carried out under the conditions shown in FIG. 3, and the maximum corrosion depth at the crevice portion was determined. The results are shown in FIG. 4. From these results, it can be understood that the maximum crevice corrosion depth is clearly reduced by setting the value of Cr+3Mo+6Ni to be 23 or more.

Next, various ferritic stainless steels were smelted, and the effect of the components on formability was investigated. As a result, it was understood that formability was excellent when Al was added in an appropriate quantity. Further, it was understood that when the ratio of Al and Nb satisfied a certain value, both of formability and resistance to ridging were superior.

Figure 5:
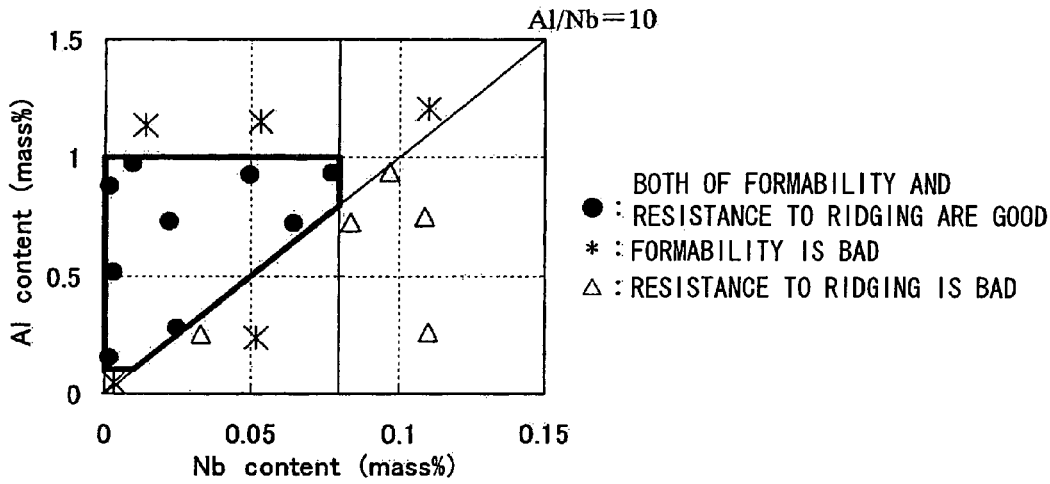
FIG. 5 shows the results of the evaluation of the formability and resistance to ridging.

Various steels were prepared by using (16 to 19%) Cr–(0.8 to 2.8%) Ni–1.0% Mo–0.2% Ti steel as the base component, and adding various amounts of Al and Nb. These steels were subjected to a process of hot-rolling, annealing, cold-rolling, and annealing so as to form steel plates having the thickness of 0.8 mm. The results of evaluation of formability and resistance to ridging are shown in FIG. 5. Here, formability was judged as "good" or "bad" based on whether or not formation was possible in a cylindrical deep drawing test explained below. Resistance to ridging was judged as "good" or "bad" based on whether or not irregularities of 5 μm or more were present in the vertical wall portion after cylindrical deep drawing.

From the figures, it can be understood that good formability and resistance to ridging is obtained within the region surrounded by the thick solid line, that is, in the case where the Al amount is 0.1% to 1.0% and the Al/Nb value is 10 or greater. It was thus understood for the first time that there is an optimal range for the amount of Al from the perspective of formability and resistance to ridging, and that either of these properties become poor when the amount of Al is either too much or too little. Moreover, it also became clear for the first time that the ratio of Nb and Al, which heretofore has not been the focus of much attention, is an extremely important index.

The mechanism by which formability is improved by the addition of a suitable amount of Al is not clear. However, it is thought that since Al is a ferrite forming element, it suppresses the formation of austenite phase at high temperatures; thereby, the texture of ferrite phase is formed which is beneficial to formability. It is also not clear why controlling Al/Nb leads to good formability and good resistance to ridging, however, it is thought that differences of influences of Nb and Al on ability of solid solution strengthening, ability to generate carbon nitrides, and rate of recrystallization contribute.

The second embodiment of the present invention was conceived based on the above understandings. The chemical compositions prescribed in this invention will now be explained in further detail below.

C: Because it decreases intergranular corrosion resistance and formability, it is necessary to keep the amount of C at low level. However, if the amount is extremely reduced, refining costs rise. Thus, the amount of C is prescribed to be in the range of 0.001 to 0.02%.

N: N is a useful element with respect to resistance to pitting corrosion. However, it lowers formability and intergranular corrosion resistance. Therefore, it is necessary to keep the amount of N at low level. However, if the amount is extremely reduced, refining costs rise. Thus, the amount of N is prescribed to be in the range of 0.001 to 0.02%.

Si: Si is useful as a deoxidizing element, and is a useful element in corrosion resistance. However, since it reduces formability, its amount is prescribed to be in the range of 0.01 to 1%. The amount is preferably in the range of 0.03 to 0.3%.

Mn: Mn is useful as a deoxidizing element. However, when Mn is included in excess, it causes a deterioration in corrosion resistance. Therefore, its amount is prescribed to be in the range of 0.05 to 1%. The amount is preferably in the range of 0.05 to 0.5%.

P: Because it reduces welding properties and formability, it is necessary to keep the amount of P at low level. However, if the amount of P is extremely reduced, raw material costs and refining costs rise. Thus, the amount of P is preferably in the range of 0.001 to 0.04%.

S: When S is present as readily soluble sulfides such as CaS and MnS, it serves as a starting point for pitting corrosion or crevice corrosion. Thus, the amount is prescribed to be in the range of 0.01% or less.

Cr: Cr is a fundamental element for ensuring resistance to crevice corrosion, and it is necessary to include Cr in an amount of at least 11% or more. Resistance to crevice corrosion improves as the amount of Cr is increased. However, with respect to resistance to penetration hole formation which is required in particular in the present invention, Cr does not have a large effect on decreasing the rate of progression after crevice corrosion occurs. Further, since Cr deteriorates formability and manufacturability, the upper limit of the Cr amount is prescribed to be 22%. The amount is preferably in the range of 15 to 22%.

Ni: With regard to resistance to penetration hole formation at crevice portions (resistance to crevice corrosion), Ni is the most effective element for decreasing the rate of progression after crevice corrosion occurs. In order to express these effects, it is necessary to include Ni in an amount of at least 0.15%. In particular, this effect is heightened further when Ni is added in combination with Mo. The effect increases as the amount of Ni is increased. However, when Ni is included in excess, susceptibility to stress corrosion cracking increases and formability declines. Further, this contributes to rising costs. Accordingly, the upper limit of the Ni amount is prescribed to be 3%. The amount is preferably in the range of 0.4 to 3%.

Mo: Mo is particularly effective against the generation of crevice corrosion. Also, by adding Mo in combination with Ni, the effect is enhanced which decreases the rate of progression after crevice corrosion occurs. Thereby, it is possible to improve the resistance to penetration hole formation at crevice portions (resistance to crevice corrosion). For this reason, it is necessary to include Mo in an amount of 0.5% or more. However, when Mo is included in excess, formability deteriorates and costs rise because Mo is expensive. Accordingly, the amount of Mo is prescribed to be in the range of 0.5 to 3%. The amount is preferably in the range of 0.5 to 2.5%.

Ti: Ti fixes C and N, and is a useful element from the perspective of improving formability and intergranular corrosion resistance at welded areas. It is necessary to include Ti in an amount of at least 0.01% or more. It is preferable to include Ti in an amount which is four-fold or greater than the sum of (C+N). However, when Ti is added in excess, Ti causes surface defects during manufacture, and leads to a deterioration in manufacturability. Thus, the upper limit of the Ti amount is set to be 0.5%. The amount is preferably in the range of 0.03 to 0.3%.

Nb: Typically, Nb is often used, in the same manner as Ti, as an element for fixing C and N. In the present invention, when Nb is added in excess, Nb causes a deterioration in formability and resistance to ridging. Moreover, it is extremely important to prescribe the Al/Nb ratio as will be described below, and adding a large amount of Nb invites an increase in the added amount of Al. Thus, the upper limit of the Nb amount is prescribed to be 0.08%. Further, in order to carry out manufacturing without a large increase in material costs, the Nb amount is preferably in the range of 0.01% or less. Here, Nb is often included in the range of 0.001 to 0.005% as an unavoidable impurity in the typical mass production manufacturing process.

Al: Al is known to have deoxidizing effects and to be a useful element in refining, and there is a case where Al is included in an amount of several tens of ppm. In the present invention, the formability of the cold-rolled steel plate is markedly improved when the added amount of Al is further increased, in particular, the effect was confirmed when the added amount exceeds 0.1%. However, when Al is added in excess, formability conversely decreases, and toughness declines. Therefore, the amount of Al is prescribed to be in the range of 1% or less. The amount is preferably in the range of more than 0.1% to 0.5% or less. The mechanism by which formability is improved by the addition of Al is not clear. However, it is thought that since Al is a ferrite forming element, it suppresses the formation of austenite phase at high temperatures; thereby, the texture of ferrite phase is formed which is beneficial to formability.

Al/Nb: The Al/Nb ratio is an index which was first elucidated by the present inventors. When this ratio is 10 or more, good formability and good resistance to ridging can be obtained. Since this ratio becomes extremely large when Nb is not added, an upper limit is not particularly prescribed. The reason is not clear why good formability and good resistance to ridging are obtained by controlling the Al/Nb ratio, however, it is thought that differences of influences of Nb and Al on ability of solid solution strengthening, ability to generate carbon nitrides, and rate of recrystallization contribute.

Cu: Cu may be included as necessary to ensure corrosion resistance. By adding Cu in combination with Ni, the effect of decreasing the rate of progression after crevice corrosion occurs is enhanced; thereby, the resistance to penetration hole formation at crevice portions (resistance to crevice corrosion) can be improved. For this reason, if Cu is included, it is preferable to include Cu in an amount of 0.1% or more. However, when Cu is included in excess, formability deteriorates and costs rise because Cu is expensive. Accordingly, if Cu is included, the amount is preferably in the range of 0.1 to 1.5%.

V: V may be included as necessary to ensure resistance to crevice corrosion. Similar to Mo, V is particularly effective with respect to the generation of crevice corrosion, however, when included in excess, costs rise. Therefore, V may be included in an amount in the range of 0.02 to 3.0%.

Further, either one or both of Cu and V are preferably included at the amounts which satisfy the following formula (A'), in order to further improve the resistance to crevice corrosion.

$$Cr+3Mo+6(Ni+Cu+V)\geqq 23 \quad (A')$$

Ca: As in the case of Al, Ca has deoxidizing effects and is a useful element in refining. Ca is preferably included as necessary in an amount of 0.0002 to 0.002%.

Mg: As in the case of Al and Ca, Mg has deoxidizing effects and is a useful element in refining. It also refines the structure and is effective in improving formability and toughness. Accordingly, Mg is preferably included as necessary in an amount of 0.0002 to 0.002%.

B: B is an element useful for improving the secondary formability, and can be included as necessary. However, when included in excess, the primary formability deteriorates. Accordingly, the B amount may be prescribed to be in the range of 0.0002 to 0.005%.

(Third Embodiment)

In the case of devices or pipes having crevice portions in their design, such as automobile components, water and hot water supply equipments, building equipments, and the like that are employed in chloride environments, the penetration hole formation (pitting) arising from crevice corrosion is an important factor determining the lifespan of the component. The present inventors extensively researched the process of penetration hole formation due to crevice corrosion, while dividing this process into an induction period up until crevice corrosion occurs, and a growth period after the occurrence of the crevice corrosion.

As a result, it became clear that in the case of ferritic stainless steel, the shortness of the latter period for corrosion growth is a major cause of shortening the duration until the penetration hole formation. Thus, it was understood that suppressing the growth rate of crevice corrosion is an important factor for improving the duration of resistance to penetration hole formation.

Figure 6:
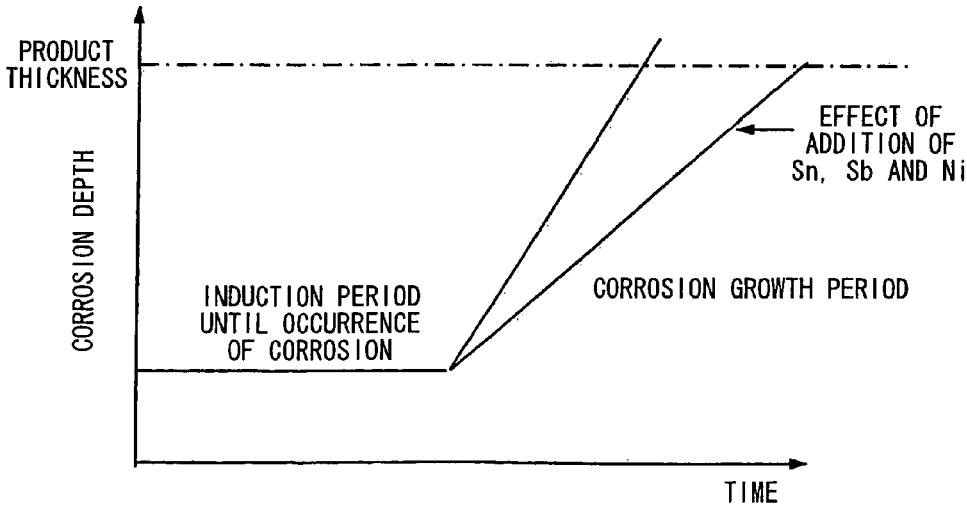
FIG. 6 is a schematic diagram showing the effects of Sn and Sb.

As a result of evaluating the impacts of various alloying elements, the present inventors discovered that, like the case of Ni which is disclosed in Japanese Patent Application, First Publication No. 2006-257544, Sn and Sb are effective for suppressing the growth rate of the crevice corrosion, and that this effect is enhanced by the combination with Ni or Mo, thereby improving resistance to penetration hole formation at crevice portions. As is shown in schematic diagram of FIG. 6, the growth rate of corrosion depth during the corrosion growth period which follows the induction period that is up until crevice corrosion occurs is markedly reduced when Sn, Sb and Ni are added.

Cold-rolled steel plates were prepared employing 0.005C-0.1Si-0.1Mn-0.025P-0.001S-18Cr-0.15Ti-0.01N as the base component, and adding any one or more of Sn, Sb, Mo, Ni, Nb and Cu. With the exception of Mo, the amount of each element added was 0.4%. The spot welded test pieces shown in FIG. 1 were employed using the cold-rolled steel plates as materials, and a repeated drying and wetting test under the conditions shown in FIG. 7 was carried out. The maximum corrosion depth at the spot welded crevice was evaluated using the same method as in the Examples. These results are shown in FIG. 8.

Addition of Sn or Sb has the same effect on reducing the maximum depth of corrosion as does the addition of Ni, and this effect is further enhanced by adding both of Sn and Sb in combination. Further, a similar effect to that of Ni is obtained even when Sn or Sb is added in combination with Mo. Thus, it is understood that Sn and Sb are effective for improving the resistance to penetration hole formation at crevice portions, and this effect is further enhanced by the combination with Ni or Mo.

Figure 9:
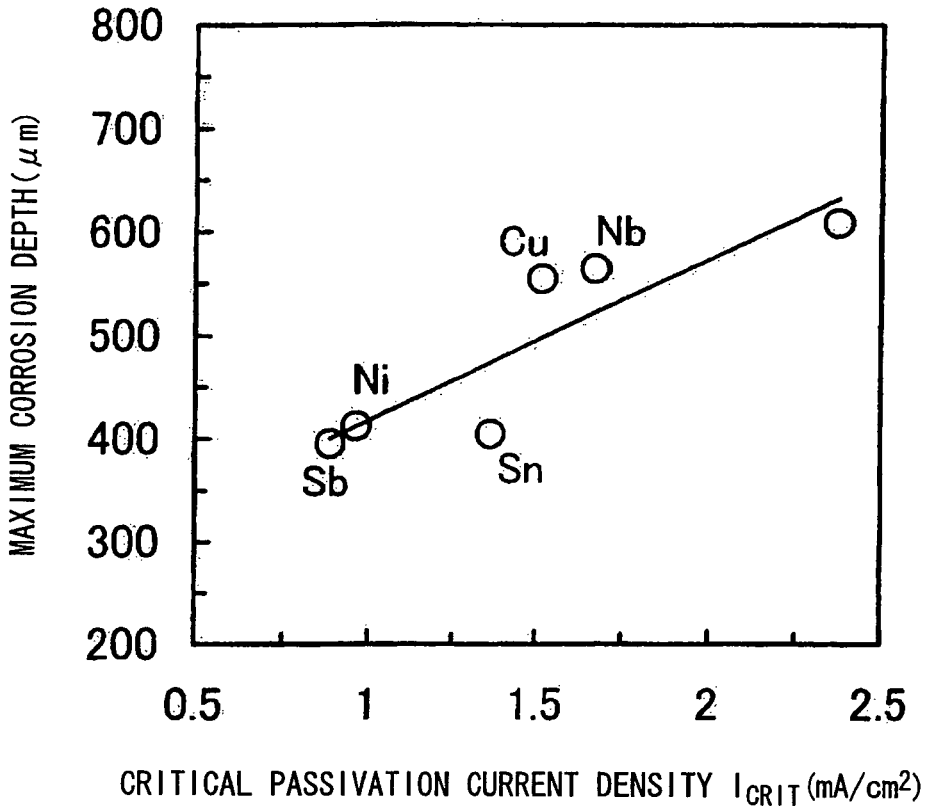
FIG. 9 shows the relationship between the critical passivation current density and the maximum corrosion depth at the crevice portion in the repeated drying and wetting test.

Next, the relationship between the results of the repeated drying and wetting tests and growth behavior of crevice corrosion were investigated electrochemically. The material containing 1% of Mo was employed from among the materials employed in the repeated drying and wetting test, and an anodic polarization curve was measured in a 20% NaCl solution having a pH of 1.5. This solution was designated as the simulated internal crevice solution after crevice corrosion occurs. The relationship between the critical passivation current density (peak current density in the active state) which is determined from the anodic polarization curve, and the maximum corrosion depth at the crevice portion in the repeated drying and wetting test is shown in FIG. 9.

A strong correlation was confirmed between these. From this result, it was understood that, like the addition of Ni, the addition of Sn or Sb has the effect of suppressing the growth rate of crevice corrosion.

The third embodiment of the present invention was conceived based on above understandings. The chemical compositions prescribed in this invention will now be explained in further detail below.

C: Because it decreases intergranular corrosion resistance and formability, it is necessary to keep the amount of C at low level. However, if the amount is extremely reduced, refining costs rise. Thus, the amount of C is prescribed to be in the range of 0.001 to 0.02%.

N: N is a useful element with respect to resistance to pitting corrosion. However, it lowers formability and intergranular corrosion resistance. Therefore, it is necessary to keep the amount of N at low level. However, if the amount is extremely reduced, refining costs rise. Thus, the amount of N is prescribed to be in the range of 0.001 to 0.02%.

Si: Si is useful as a deoxidizing element, and is a useful element in corrosion resistance. However, since it reduces formability, its amount is prescribed to be in the range of 0.01 to 0.5%. The amount is preferably in the range of 0.05 to 0.4%.

Mn: Mn is useful as a deoxidizing element. However, when Mn is included in excess, it causes a deterioration in corrosion resistance. Therefore, its amount is prescribed to be in the range of 0.05 to 1%. The amount is preferably in the range of 0.05 to 0.5%.

P: Because it reduces welding properties and formability, it is necessary to keep the amount of P at low level. However, if the amount of P is extremely reduced, raw material costs and refining costs rise. Thus, the amount of P is prescribed to be in the range of 0.04% or less.

S: When S is present as readily soluble sulfides such as CaS and MnS, it serves as a starting point for pitting corrosion or crevice corrosion. Thus, the amount is prescribed to be in the range of 0.01% or less.

Cr: Cr is a fundamental element for ensuring resistance to crevice corrosion, and it is necessary to include Cr in an amount of at least 12% or more. Resistance to crevice corrosion improves as the amount of Cr is increased. However, with respect to resistance to penetration hole formation which is required in particular in the present invention, Cr does not have a large effect on decreasing the rate of progression after crevice corrosion occurs. Further, since Cr deteriorates formability and manufacturability, the upper limit of the Cr amount is prescribed to be 25%. The amount is preferably in the range of 15 to 22%.

Ti, Nb: Ti and Nb fix C and N, and are useful elements from the perspective of improving formability and intergranular corrosion resistance at welded areas. It is necessary to include either one or both of Ti and Nb in each amount of at least 0.02% or more. When only one of Ti and Nb is included, it is preferable to include Ti in an amount which is four-fold or greater than the sum of (C+N), and to include Nb in an amount that is eight-fold or greater than the sum of (C+N). When both of Ti and Nb are included, it is preferable to include Ti and Nb in amounts satisfying the relation that (Ti+Nb)/(C+N) is six or more. However, when Ti is added in excess, Ti causes surface defects during manufacture, and leads to a deterioration in manufacturability. Likewise, when Nb is added in excess, Nb causes a deterioration in formability. Thus, the upper limit of the Ti amount is set to be 0.5% and the upper limit of the Nb amount is set to be 1%. The Ti amount is preferably in the range of 0.03 to 0.3%, and the Nb amount is preferably in the range of 0.05 to 0.6%.

Sn, Sb: With regard to resistance to crevice corrosion, particularly, resistance to penetration hole formation at crevice portions, Sn and Sb are extremely useful elements for decreasing the rate of progression after crevice corrosion occurs. This effect is particularly enhanced when Sn or Sb is included in combination with Ni or Mo. In order to express this effect, it is necessary to include Sn or Sb in each amount of at least 0.005%. While this effect is enhanced as the amount of Sn or Sb is increased, when included in excess, Sn and Sb cause a deterioration in formability and hot workability. Thus, the amount of Sn is prescribed to be in the range of 0.005 to 2%, and the amount of Sb is prescribed to be in the range of 0.005% to 1%. The amount of Sn is preferably in the range of 0.01 to 1%, and the amount of Sb is preferably in the range of 0.005 to 0.5%.

Ni: Ni may be included as necessary to improve resistance to crevice corrosion. With regard to resistance to penetration hole formation at crevice portions (resistance to crevice corrosion), Ni is extremely useful element for decreasing the rate of progression after crevice corrosion occurs. Ni has effects similar to Sn and Sb, even when used alone. When Ni is added in combination with Sn and Sb, its effects are even further enhanced. This effect becomes stable at the amount of 0.2% or more. The effect of Ni is enhanced as the amount of Ni is increased, however, when included in excess, susceptibility to stress corrosion cracking increases and formability declines. Further, this contributes to rising costs. Thus, it is preferable to include Ni in an amount of 0.2 to 5%.

Mo: Mo may be included as necessary to improve resistance to crevice corrosion. Mo is particularly effective against the generation of crevice corrosion. In addition to it, the effect on suppressing the rate of progression after crevice corrosion occurs is enhanced when Mo is added in combination with Sn or Sb, or in combination with Ni. Thus, it is possible to improve resistance to penetration hole formation at a crevice portion (resistance to crevice corrosion). This effect becomes stable at an amount of 0.3% or more. This effect of Mo is enhanced as the amount of Mo is increased, however, when Mo is included in excess, Mo causes a deterioration in formability and contributes to rising costs because Mo is expensive. Thus, it is preferable to include Mo in an amount of 0.3 to 3%.

Cu: Cu may be included as necessary to ensure resistance to crevice corrosion. Cu is effective for decreasing the rate of progression after crevice corrosion occurs, and it is preferable to include Cu in an amount of 0.1% or more. However, when Cu is included in excess, formability deteriorates. Accordingly, it is preferable to include Cu in an amount of 0.1 to 1.5%.

V: V may be included as necessary for the purpose of further improving resistance to crevice corrosion. Similar to Mo, V is effective against the generation of crevice corrosion and is also effective for decreasing the rate of progression after crevice corrosion occurs. This effect becomes stable at an amount of 0.02% or more. This effect is enhanced as the amount of V is increased, however, when V is included in excess, V leads to rising costs. Therefore, it is preferable to include V in an amount of 0.02 to 3.0%.

W: W may be included as necessary for the purpose of further improving resistance to crevice corrosion. Similar to Mo and V, W is effective against the generation of crevice corrosion and is also effective for decreasing the rate of progression after crevice corrosion occurs. This effect becomes stable at an amount of 0.3% or more. This effect is enhanced as the amount of W is increased, however, when W is included in excess, W leads to rising costs Therefore, it is preferable to include W in an amount of 0.3 to 5.0%.

Al: Al has deoxidizing effects and is a useful element in refining. It also improves formability. Therefore, it is preferable to include Al in an amount of 0.003 to 1%.

Ca: As in the case of Al, Ca has deoxidizing effects and is a useful element in refining. It is preferable to include Ca in an amount of 0.0002 to 0.002%.

Mg: As in the case of Al and Ca, Mg has deoxidizing effects and is a useful element in refining. It also refines the structure and is effective in improving formability and toughness. Accordingly, it is preferable to include Mg in an amount of 0.0002 to 0.002%.

B: B is an element useful for improving the secondary formability. It is preferable to include B in an amount of 0.0002 to 0.005%.

EXAMPLES

Example 1

Steels having the chemical compositions shown in Tables 1 and 2 were smelted, and these steels were subjected to a process of hot-rolling, annealing of hot-rolled plates, cold-rolling, and finish annealing so as to produce steel plates having the thickness of 1.0 mm. Using these cold-rolled steel plates, the corrosion resistance and the ductility at room temperature were evaluated.

TABLE 1

| | Chemical Composition of Test Steel (mass %) | | | | | | | | | | | Finish annealing |
|---|---|---|---|---|---|---|---|---|---|---|---|---|
| No. | C | Si | Mn | P | S | Cr | Ni | Ti | Nb | N | Other | (° C.) |
| A1 | 0.005 | 0.24 | 0.12 | 0.025 | 0.001 | 20.12 | 3.04 | 0.19 | 0.011 | 0.006 | — | 1050 |
| A2 | 0.006 | 0.22 | 0.20 | 0.028 | 0.001 | 20.34 | 3.02 | 0.004 | 0.25 | 0.007 | — | 1050 |
| A3 | 0.007 | 0.14 | 0.15 | 0.026 | 0.002 | 19.66 | 3.11 | 0.17 | 0.008 | 0.009 | 1.23 Mo, 0.023 Al, 0.0005 B | 1025 |
| A4 | 0.006 | 0.27 | 0.18 | 0.022 | 0.001 | 21.12 | 3.45 | 0.18 | 0.26 | 0.007 | 0.89 Mo | 1000 |
| A5 | 0.005 | 0.14 | 0.17 | 0.021 | 0.001 | 19.84 | 3.22 | 0.20 | 0.29 | 0.006 | 1.12 Mo, 0.29 Nb, 0.41 V, 0.0005 Mg 0.0004 B | 1050 |
| A6 | 0.004 | 0.22 | 0.16 | 0.022 | 0.001 | 22.44 | 4.12 | 0.19 | 0.009 | 0.007 | 0.99 Mo, 0.25 Cu | 1050 |
| A7 | 0.004 | 0.13 | 0.12 | 0.023 | 0.001 | 18.22 | 3.32 | 0.16 | 0.012 | 0.007 | 1.00 Mo, 0.88 W, 0.32 Zr | 1050 |
| A8 | 0.015 | 0.08 | 0.35 | 0.018 | 0.007 | 16.51 | 3.15 | 0.001 | 0.25 | 0.003 | 0.15 V, 0.99 Al, 0.0034 B | 1060 |
| A9 | 0.003 | 0.42 | 0.06 | 0.038 | 0.006 | 24.01 | 4.87 | 0.41 | 0.001 | 0.018 | 2.1 Mo, 0.34 W, 0.0011 Ca, 0.0018 Mg | 1010 |

TABLE 2

| | Chemical Composition of Test Steel (mass %) | | | | | | | | | | | Finish annealing |
|---|---|---|---|---|---|---|---|---|---|---|---|---|
| No. | C | Si | Mn | P | S | Cr | Ni | Ti | Nb | N | Other | (° C.) |
| A10 | 0.017 | 0.12 | 0.13 | 0.018 | 0.003 | 19.00 | 3.93 | 0.13 | 0.21 | 0.006 | 0.51 Cu 2.21 W 0.10 Zr 0.34 Al 0.0037 B | 1030 |
| A11 | 0.011 | 0.23 | 0.07 | 0.031 | 0.005 | 12.30 | 3.05 | 0.35 | 0.22 | 0.014 | 0.51 Mo 1.98 V 0.79 Al 0.0018 Ca 0.0002 Mg | 1020 |
| A12 | 0.004 | 0.11 | 0.13 | 0.024 | 0.001 | 18.31 | 3.01 | 0.19 | 0.001 | 0.006 | 1.09 Mo 0.46 Al 0.0004 E | 980 |
| A13 | 0.011 | 0.35 | 0.47 | 0.002 | 0.008 | 23.15 | 4.44 | 0.002 | 0.45 | 0.013 | 0.20 V 0.25 Al | 1020 |
| A14 | 0.004 | 0.21 | 0.16 | 0.024 | 0.002 | 19.26 | 2.23 | 0.16 | 0.015 | 0.008 | — | 1000 |
| A15 | 0.006 | 0.32 | 0.16 | 0.024 | 0.001 | 20.26 | 5.45 | 0.12 | 0.004 | 0.006 | — | 1000 |
| A16 | 0.005 | 0.12 | 0.13 | 0.025 | 0.001 | 18.22 | 3.12 | 0.17 | 0.006 | 0.008 | — | 1150 |
| A17 | 0.04 | 0.45 | 0.89 | 0.024 | 0.004 | 18.12 | 8.22 | 0.005 | 0.007 | 0.04 | (SUS304) | 1050 |
| A18 | 0.016 | 1.92 | 0.61 | 0.019 | 0.001 | 18.14 | 10.15 | 0.008 | 0.008 | 0.05 | (SUS315J1) | 1050 |

Note:
Underline indicates a value that is outside the range of the present invention.

(Resistance to Crevice Corrosion)

A test piece having the width of 60 mm and the length of 130 mm and a test piece having the width of 30 mm and the length of 60 mm were cut from the cold-rolled steel. Wet polishing was then carried out using emery paper #320. These large test piece and small test piece were then stacked and were spot-welded at two points, such as shown in FIG. 1 ((positions (spot welding sites 1) indicated by O in FIG. 1). The end surfaces and the rear surface of the test piece having the width of 60 mm and the length of 130 mm were covered with sealing tape.

Figure 2:
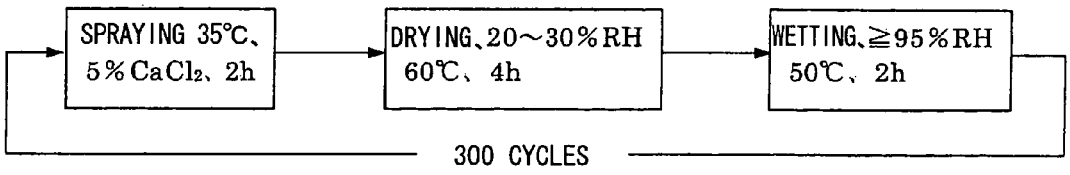
FIG. 2 shows the conditions for the repeated drying and wetting test in Example 1.

Using these test pieces, a repeated drying and wetting test was carried out under the conditions indicated in FIG. 2. The spray solution was a 5% calcium chloride aqueous solution. During the test cycle, a concentrated calcium chloride environment was provided from the time when the process was switched from the spraying process to the drying process until the inside of the crevice became completely dry. In addition, chloride ions were deposited inside the crevice as the cycle progressed; thereby, this also provided a concentrated calcium chloride environment. After the completion of 300 cycles, the large and small test pieces were separated. Next, corroded products were removed, and depths of corrosion at the spot welded crevice portions were measured using the focal depth method. In addition to the conditions prescribed here, testing was carried out in conformity with JASO M609-91 which is the corrosion testing method for automobile materials prescribed by Society of Automotive Engineers of Japan. The maximum value for corrosion depth was obtained from among corrosion depth values measured at 10 or more points. In the case in which the maximum value was 400 μm or less, the test piece was rated as "good", and in the case in which the maximum value was more than 400 μm, the test piece was rated as "bad". The thicknesses of the stainless steel plates employed in the salt-induced corrosion environment which is the subject of the present invention are mainly in the range of 0.8 to 2 mm, and therefore, the thickness of 400 μm which is one half the thinnest thickness was taken as the standard.

(Resistance to Stress Corrosion Cracking)

Test pieces having the width of 15 mm and the length of 75 mm were cut out from the cold-rolled steel plate parallel to the rolled direction. The test pieces were bent at the curvature of 8R, and were bundled in parallel so as to form a U-bend test piece. 10 μl of artificial seawater was then dripped onto two sites on the outer surface of the R portion of the U-bend test piece. The U-bend test piece was placed in a thermohydrostatic tester in a state where the R portion of the U-bend test piece was directed upward, and was maintained for 672 hours at 80° C. and 40% RH. Under these conditions, the sodium chloride contained in the artificial seawater was completely dried, to form a concentrated magnesium chloride environment. After the test was completed, the outer surface and the cross-section of the R portion of the test piece were observed and evaluated whether stress corrosion cracking was present or absent.

(Microstructure and Ductility at Room Temperature)

The ratio of the second phase including martensite phase and austenite phase was determined by image analysis based on pictures of the cross-sectional microstructure at 500-fold magnification. The grain size number of ferrite phase was measured in accordance with JISG 0552.

Ductility at room temperature was measured by obtaining pieces for JIS 13B tensile testing that were obtained parallel to the rolled direction from the test pieces described above. These test pieces were then subjected to room temperature tensile testing; thereby, total elongation was measured. A target of 20% was established for total elongation which is desirable value for formation of components such as building materials, outside equipments, fuel tanks and pipes for automobiles and two-wheeled vehicles, and the like, that are the subjects of the present invention.

These test results are shown in Table 3.

TABLE 3

| No. | Resistance to crevice corrosion | Resistance to stress corrosion cracking | Ratio of second phase (%) | Grain size number | Elongation at room temperature (%) |
|---|---|---|---|---|---|
| A1 | good | good | 0 | 7 | 27.8 |
| A2 | good | good | 0 | 7 | 28.2 |
| A3 | good | good | 0 | 7.5 | 25.6 |
| A4 | good | good | 0 | 6 | 23.4 |
| A5 | good | good | 0 | 7 | 24.6 |
| A6 | good | good | 12 | 6.5 | 21.5 |
| A7 | good | good | 0 | 7 | 24.2 |
| A8 | good | good | 1 | 7.5 | 23.5 |
| A9 | good | good | 0 | 8.5 | 24.3 |
| A10 | good | good | 5 | 9 | 22.9 |
| A11 | good | good | 0 | 8 | 26.3 |
| A12 | good | good | 0 | 8 | 29.8 |
| A13 | good | good | 0 | 7.5 | 25.3 |
| A14 | bad | good | 0 | 7 | 28.9 |
| A15 | good | good | 50 | 9 | 12.5 |
| A16 | good | good | 0 | 3.5 | 18.5 |
| A17 | good | bad | 100 | 8 | 58.2 |
| A18 | good | bad | 100 | 7 | 54.2 |

(Note)

Underline indicates cases where the ratio of the second phase exceeded 15% or the grain size number was less than No. 4.

The steels of No. A1 to No. A13, which are within the scope of the present invention, had maximum corrosion depths of 400 μm or less at the crevice portions. In addition, these steel samples did not experience cracking during the test for stress corrosion cracking, and demonstrated excellent corrosion resistance, as well as these steel samples had elongations at room temperature of 20% or more, and had excellent formability.

The steel of No. A14, in which the Ni amount was out of the range prescribed for the present invention, had good resistance to stress corrosion cracking and good elongation at room temperature, but had inferior resistance to crevice cracking. The steel of No. A15, in which the Ni amount and the ratio of the second phase were out of the ranges prescribed for the present invention, had good resistance to crevice corrosion and good resistance to stress corrosion cracking, but the elongation at room temperature was less than 20% and therefore, the formability was bad. The steel of No. A16, in which the grain size number was less than No. 4, had the elongation at room temperature of less than 20% and therefore, the formability was bad. The steels of Nos. A17 and A18 correspond to SUS 304 and SUS 315J1 steels, respectively. These steels had good resistance to crevice corrosion, but experienced cracking during the tests for stress corrosion cracking and thus were inferior in resistance to stress corrosion cracking.

Example 2

Steels having the chemical compositions shown in Table 4 were smelted, and these steels were subjected to a process of hot-rolling, cold-rolling and annealing so as to produce steel plates having the thickness of 1.0 mm. Using these cold-rolled steel plates, resistance to crevice corrosion, formability, and resistance to ridging were evaluated.

TABLE 4

| | | Composition (mass %) | | | | | | | | | | | | |
|---|---|---|---|---|---|---|---|---|---|---|---|---|---|---|
| | No | C | Si | Mn | P | S | Ni | Cr | Mo | Ti | Nb | Al | N | Other |
| Inventive Example | B1 | 0.001 | 0.12 | 0.09 | 0.028 | 0.0012 | 0.4 | 20.8 | 1.0 | 0.14 | 0.014 | 0.25 | 0.010 | |
| | B2 | 0.004 | 0.35 | 0.21 | 0.024 | 0.0004 | 0.6 | 17.4 | 1.5 | 0.15 | 0.003 | 0.34 | 0.009 | 0.06 V, 0.0003 B |
| | B3 | 0.013 | 0.78 | 0.14 | 0.034 | 0.0021 | 1.0 | 19.2 | 1.2 | 0.35 | 0.002 | 0.68 | 0.010 | 0.0002 Mg, 0.0006 B |
| | B4 | 0.004 | 0.05 | 0.19 | 0.015 | 0.0055 | 2.0 | 17.9 | 0.6 | 0.19 | 0.002 | 0.89 | 0.010 | 0.0002 Ca |
| | B5 | 0.002 | 0.12 | 0.35 | 0.015 | 0.0003 | 0.3 | 16.5 | 2.1 | 0.17 | 0.005 | 0.22 | 0.013 | 0.12 V |
| | B6 | 0.004 | 0.10 | 0.11 | 0.028 | 0.0011 | 2.9 | 18.1 | 1.0 | 0.21 | 0.001 | 0.12 | 0.008 | 0.0005 B |
| | B7 | 0.018 | 0.11 | 0.88 | 0.033 | 0.0079 | 0.4 | 18.0 | 1.0 | 0.42 | 0.003 | 0.16 | 0.011 | 0.15 Cu, 0.0011 Ca, 0.0011 B |
| | B8 | 0.011 | 0.39 | 0.68 | 0.038 | 0.0014 | 2.0 | 19.9 | 0.5 | 0.21 | 0.033 | 0.42 | 0.009 | 0.23 Cu, 2.10 V |
| | B9 | 0.005 | 0.10 | 0.12 | 0.011 | 0.0025 | 3.0 | 18.1 | 0.7 | 0.25 | 0.045 | 0.68 | 0.016 | 0.0041 Ca |
| | B10 | 0.003 | 0.23 | 0.15 | 0.026 | 0.0011 | 2.9 | 14.5 | 1.8 | 0.32 | 0.004 | 0.11 | 0.007 | |
| | B11 | 0.009 | 0.11 | 0.77 | 0.038 | 0.0022 | 2.5 | 21.1 | 2.6 | 0.18 | 0.071 | 0.89 | 0.004 | 0.0039 Mg, 0.0048 B |
| | B12 | 0.001 | 0.05 | 0.06 | 0.019 | 0.0033 | 2.2 | 20.4 | 0.6 | 0.25 | 0.022 | 0.31 | 0.008 | 1.35 Cu |
| | B13 | 0.002 | 0.39 | 0.24 | 0.025 | 0.0005 | 2.8 | 16.3 | 0.8 | 0.07 | 0.002 | 0.9 | 0.004 | 0.51 V |
| Comparative Example | B14 | 0.004 | 0.11 | 0.10 | 0.027 | 0.0007 | 0.03 | 17.9 | 1.0 | 0.13 | 0.014 | 0.21 | 0.011 | 0.0034 Ca, 0.0028 Mg |
| | B15 | 0.002 | 0.53 | 0.09 | 0.035 | 0.0009 | 0.2 | 17.5 | 0.3 | 0.35 | 0.002 | 0.15 | 0.016 | 0.32 Cu, 0.0003 Mg |
| | B16 | 0.001 | 0.25 | 0.65 | 0.021 | 0.0012 | 1.2 | 16.5 | 2.1 | 0.21 | 0.055 | 0.06 | 0.009 | 0.005 B |
| | B17 | 0.009 | 0.05 | 0.25 | 0.019 | 0.0055 | 2.1 | 19.5 | 1.8 | 0.29 | 0.12 | 0.25 | 0.016 | 0.2 V |

Note:
Underline indicates a value that is outside the range of the present invention (Resistance to Crevice Corrosion)

A test piece having the width of 60 mm and the length of 130 mm and a test piece having the width of 30 mm and the length of 60 mm were cut from the cold-rolled steel. Wet polishing was then carried out using emery paper #320. The test pieces were spot-welded into the form shown in FIG. 1, and the end surfaces and the rear surface of the test piece having the width of 60 mm and the length of 130 mm were covered with sealing tape. Using these test pieces, a repeated drying and wetting test was carried out under the conditions indicated in FIG. 3. After the completion of 180 cycles, the large and small test pieces were separated. Next, the corroded products were removed, and depth of corrosions at the spot welded crevice portions were measured using an optical microscope focal depth method. In addition to the conditions prescribed here, testing was carried out in conformity with JASO M609-91 which is the corrosion testing method for automobile materials prescribed by Society of Automotive Engineers of Japan.

The maximum value for corrosion depth was obtained from among corrosion depth values measured at 10 or more points. In the case in which the maximum value was 800 μm or less, the test piece was rated as "good", and in the case in which the maximum value was more than 800 μm, the test piece was rated as "bad". The thicknesses of the stainless steel plates which are the subject of the present invention are mainly in the range of 0.8 to 2.0 mm, and therefore, the thinnest thickness was taken as the standard.

(Formability)

Formability was evaluated by a cylindrical deep drawing test. The forming conditions were as follows. Punch diameter: ϕ50 mm; punch shoulder R: 5 mm; dice shoulder R: 5 mm; blank diameter: ϕ100 mm; blank holder force: 1 ton; and friction coefficient: 0.11 to 0.13. Here, this friction coefficient is the level obtained by coating lubricating oil to the front and the rear surface of the steel sheet at a kinematic viscosity of 1200 $mm^2$/mm at 40° C. Formability was evaluated based on whether or not it was possible to carry out deep drawing formation at a forming limit drawing ratio of 2.20 under the conditions described above. In other words, in the case in which formation was possible, the steel was rated as "good". In the case in which formation cracks occurred during the process, the steel was rated as "bad".

(Resistance to Ridging)

Resistance to ridging was evaluated using tensile test pieces obtained from the cold-rolled steel plate parallel to the rolled direction. These test pieces were elongated by 15%, and then surface irregularities (waviness) in the rolled direction and in the vertical direction were measured using a two-dimensional roughness meter. The maximum height of the irregularities was defined as the ridging height. In the case in which the ridging height was less than 15 μm, the steel was rated as "good". In the case in which the ridging height was 15 μm or more, the steel was rated as "bad".

These test results are shown in Table 5.

TABLE 5

| No. | Value of Formula (A) | Value of Formula (B) | Resistance to crevice corrosion | Formability | Resistance to ridging | Comments |
|---|---|---|---|---|---|---|
| B1 | 26.2 | 18 | good | good | good | Inventive Example |
| B2 | 25.9 | 113 | good | good | good | Inventive Example |
| B3 | 28.8 | 340 | good | good | good | Inventive Example |
| B4 | 31.7 | 445 | good | good | good | Inventive Example |
| B5 | 25.3 | 44 | good | good | good | Inventive Example |
| B6 | 38.5 | 120 | good | good | good | Inventive Example |
| B7 | 24.3 | 53 | good | good | good | Inventive Example |
| B8 | 47.4 | 13 | good | good | good | Inventive Example |
| B9 | 38.2 | 15 | good | good | good | Inventive Example |
| B10 | 37.3 | 28 | good | good | good | Inventive Example |
| B11 | 43.9 | 13 | good | good | good | Inventive Example |
| B12 | 43.5 | 14 | good | good | good | Inventive Example |
| B13 | 38.6 | 450 | good | good | good | Inventive Example |
| B14 | 21.1 | 15 | bad | good | good | Comparative Example |
| B15 | 21.5 | 75 | bad | good | good | Comparative Example |
| B16 | 30 | 1 | good | bad | bad | Comparative Example |
| B17 | 38.7 | 2 | good | bad | bad | Comparative Example |

Note:
Underline indicates a value outside the range of the present invention.

The steels of No. B1 to No. B13, which are within the scope of the present invention, had excellent resistance to crevice corrosion, excellent formability, and excellent resistance to ridging.

The steel of No. B14, in which the Ni amount and the value of Formula (A) were out of the ranges prescribed for the present invention, and the steel of No. B15, in which the Mo amount and the value of Formula (A) were out of the ranges prescribed for the present invention, had inferior resistance to crevice corrosion. Further, the steel of No. B16, in which the Al amount and the value of Formula (B) were out of the ranges prescribed for the present invention, had inferior resistance to ridging. The steel of No. B17, in which the Nb amount and the value of Formula (B) were out of the ranges prescribed for the present invention, had both of inferior formability and inferior resistance to ridging.

From the above examples, the effects of the present invention were thus confirmed.

Example 3

Steels having the chemical compositions shown in Table 6 were smelted, and these steels were subjected a process of to hot-rolling, cold-rolling and annealing so as to form steel plates having the thickness of 1.0 mm. Using these cold-rolled steel plates, resistance to crevice corrosion were evaluated.

TABLE 6

| | | Composition (mass %) | | | | | | | | | | |
|---|---|---|---|---|---|---|---|---|---|---|---|---|
| | No. | C | Si | Mn | P | S | Ni | Cr | Ti | Nb | Sn | Sb |
| Inventive Example | C1 | 0.005 | 0.38 | 0.26 | 0.027 | 0.001 | | 16.21 | 0.25 | | 0.41 | |
| | C2 | 0.008 | 0.36 | 0.25 | 0.025 | 0.001 | | 15.99 | 0.23 | | | 0.22 |
| | C3 | 0.005 | 0.35 | 0.35 | 0.026 | 0.002 | 0.21 | 16.62 | 0.18 | | 0.35 | |
| | C4 | 0.012 | 0.12 | 0.25 | 0.020 | 0.001 | | 17.28 | 0.25 | | | 0.28 |
| | C5 | 0.003 | 0.49 | 0.65 | 0.016 | 0.005 | 0.36 | 18.25 | | 0.20 | 0.49 | |
| | C6 | 0.008 | 0.25 | 0.12 | 0.032 | 0.002 | 0.68 | 13.56 | 0.18 | 0.25 | | 0.03 |
| | C7 | 0.005 | 0.18 | 0.16 | 0.025 | 0.001 | 1.00 | 18.20 | 0.19 | | 0.22 | 0.13 |
| | C8 | 0.007 | 0.26 | 0.36 | 0.029 | 0.001 | 1.26 | 19.46 | 0.20 | | 0.007 | |
| | C9 | 0.003 | 0.21 | 0.32 | 0.021 | 0.001 | 1.46 | 17.69 | 0.16 | 0.20 | | 0.006 |
| | C10 | 0.006 | 0.16 | 0.22 | 0.024 | 0.001 | 1.76 | 19.68 | | 0.36 | 0.01 | 0.006 |
| | C11 | 0.004 | 0.13 | 0.22 | 0.023 | 0.008 | 2.03 | 20.25 | | 0.32 | 0.04 | |
| | C12 | 0.006 | 0.08 | 0.10 | 0.022 | 0.001 | 4.60 | 24.56 | 0.22 | | 0.01 | |
| | C13 | 0.005 | 0.42 | 0.75 | 0.028 | 0.001 | 0.25 | 15.22 | 0.12 | 0.26 | 0.76 | |
| Comparative Example | C14 | 0.004 | 0.42 | 0.22 | 0.025 | 0.004 | | 14.86 | 0.26 | | 0.003 | |
| | C15 | 0.007 | 0.12 | 0.16 | 0.021 | 0.002 | | 15.22 | | 0.35 | | 0.002 |
| | C16 | 0.006 | 0.42 | 0.36 | 0.028 | 0.003 | | 10.95 | 0.20 | | 0.33 | |

| | | Composition (mass %) | | | | | | | | |
|---|---|---|---|---|---|---|---|---|---|---|
| | No. | N | Mo | Cu | V | W | Al | Ca | Mg | B |
| Inventive Example | C1 | 0.011 | | | | | | | | |
| | C2 | 0.009 | | | | | | | | |
| | C3 | 0.008 | | | | | | | | |
| | C4 | 0.015 | 1.15 | | | | 0.03 | | | 0.0005 |
| | C5 | 0.004 | | 0.44 | | | 0.01 | | 0.0005 | |
| | C6 | 0.011 | 0.78 | | | 2.50 | 0.15 | 0.0010 | | |

TABLE 6-continued

| | | | | | | | | |
|---|---|---|---|---|---|---|---|---|
| | C7 | 0.008 | 0.99 | | | 0.06 | | 0.0003 |
| | C8 | 0.009 | 1.05 | | | 0.01 | 0.0006 | 0.0004 |
| | C9 | 0.008 | 1.43 | 0.22 | | | 0.0005 | 0.0005 |
| | C10 | 0.012 | 0.82 | | | 0.04 | | 0.0006 |
| | C11 | 0.006 | | | 0.46 | | 0.0004 | |
| | C12 | 0.005 | 2.66 | | | | | |
| | C13 | 0.016 | 1.23 | 0.35 | | | | 0.0004 |
| Comparative Example | C14 | 0.008 | | | | 0.05 | | |
| | C15 | 0.009 | | | | | | |
| | C16 | 0.008 | | | | | | |

Note:
Underline indicates a value outside the range of the present invention.

A test piece having the width of 60 mm and the length of 130 mm and a test piece having the width of 30 mm and the length of 60 mm were cut from the cold-rolled steel. Wet polishing was then carried out using emery paper #320. The test pieces were spot-welded into the form shown in FIG. 1, and the end surfaces and the rear surface of the test piece having the width of 60 mm and the length of 130 mm were covered with sealing tape.

Figure 7:
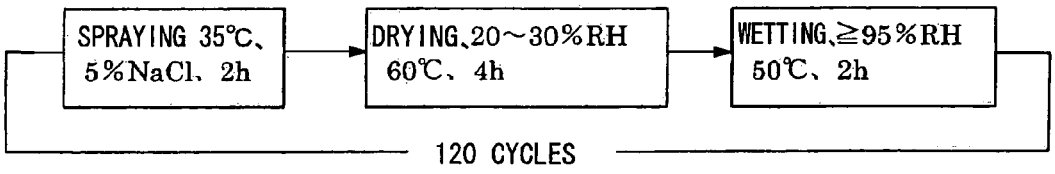
FIG. 7 shows the conditions for the repeated drying and wetting test in Example 3.
Figure 8:
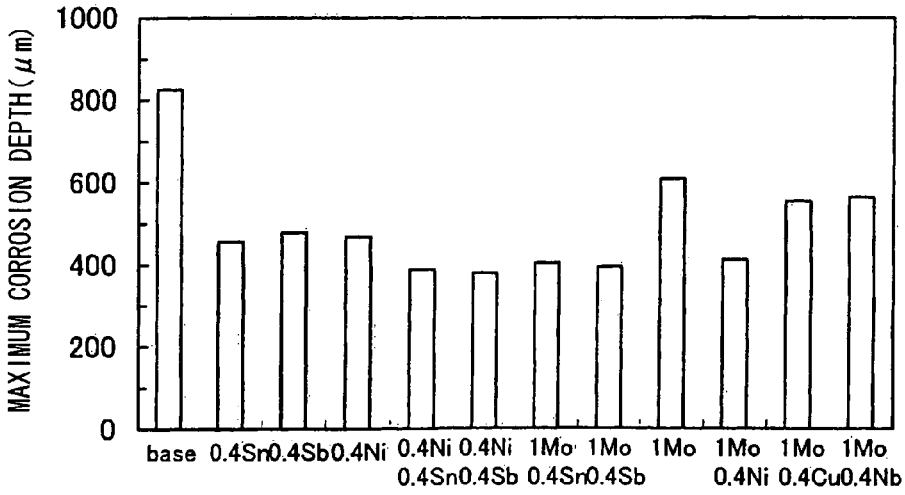
FIG. 8 shows the results for the repeated drying and wetting test.

Using these test pieces, a repeated drying and wetting test was carried out under the conditions indicated in FIG. 7. After the completion of 120 cycles, the large and small test pieces were separated. Next, the corroded products were removed, and depth of corrosions at the spot welded crevice portions were measured using an optical microscope focal depth method. The maximum value was obtained from among corrosion depth values measured at 10 or more points where deep corrosion appeared to have occurred. In addition to the conditions prescribed here, testing was carried out in conformity with JASO M609-91 which is the corrosion testing method for automobile materials prescribed by Society of Automotive Engineers of Japan.

These test results are shown in Table 7.

TABLE 7

| | No. | Maximum corrosion depth (μm) |
|---|---|---|
| Inventive Example | C1 | 516 |
| | C2 | 534 |
| | C3 | 487 |
| | C4 | 402 |
| | C5 | 376 |
| | C6 | 397 |
| | C7 | 213 |
| | C8 | 205 |
| | C9 | 188 |
| | C10 | 168 |
| | C11 | 336 |
| | C12 | 138 |
| | C13 | 356 |
| Comparative Example | C14 | 846 |
| | C15 | 875 |
| | C16 | 925 |

The steels of No. C1 to No. C13, which are within the scope of the present invention, had maximum corrosion depths of 600 μm or less, and therefore, their resistances to crevice corrosion were excellent. The steel of No. C14 in which the Sn amount was out of the range prescribed for the present invention, the steel of No. C15 in which the Sb amount was out of the range prescribed for the present invention, and the steel of No. C16 in which the Cr amount was out of the range prescribed for the present invention, had maximum corrosion depths of 800 μm or more, and therefore, their resistances to crevice corrosion were inferior. From the above examples, the effects of the present invention were thus confirmed.

INDUSTRIAL APPLICABILITY

The first embodiment of the present invention is suitable for building materials and outside equipments in a marine environment where airborne salt is ubiquitous, as well as for component parts of automobiles and two-wheeled vehicles which travel over cold regions where antifreezing agents are spread in winter.

The ferritic stainless steel having excellent resistance to penetration hole formation at crevice portions (resistance to crevice corrosion) and superior formability according to the second embodiment of the present invention is useful for components where crevices are present in the design, and where superior resistance to crevice corrosion and superior formability are required, such as exhaust system components and fuel system components of automobiles and two-wheeled vehicles, hot-water supply equipments, and the like. In particular, this ferritic stainless steel is suitable for important components where a long lifespan is required, such as automobile fuel tanks and fuel oil supply pipes.

The ferritic stainless steel having excellent resistance to crevice corrosion, and particularly excellent resistance to penetration hole formation at crevice portions, according to the third embodiment of the present invention, is useful as a material employed in components that require superior resistance to crevice corrosion, in equipments and pipings that have crevice portions in their design and are used in chloride environments, such as automobile components, water and hot water supply equipments, building equipments, and the like.

The invention claimed is:

1. A ferritic stainless steel consisting of, in terms of mass %,

C: 0.001 to 0.02%, N: 0.001 to 0.02%, Si: 0.01 to 0.5%, Mn: 0.05 to 1%, P: 0.04% or less, S: 0.01% or less, Cr: 12 to 25%, Ti: 4(C+N) to 0.5%, B: 0.0002 to 0.0004%, Sn: 0.01 to 2%, and optionally, one or more of Sb: 0.005 to 1%, Nb: 0.02 to 1%, Ni: 0.2 to 5%, Cu: 1.5% or less, W: 5% or less, Al: 1% or less, and Ca: 0.002% or less, with a remainder of Fe and unavoidable impurities.

2. A ferritic stainless steel consisting of, in terms of mass %,

C: 0.001 to 0.02%, N: 0.001 to 0.02%, Si: 0.01 to 0.5%, Mn: 0.05 to 1%, P: 0.04% or less, S: 0.01% or less, Cr: 12 to 25%, Ti: 4(C+N) to 0.5%, B: 0.0002 to 0.0004%, Sn: 0.01 to 2%, and optionally, one or more of Sb: 0.005 to 1%, Nb: 0.02 to 1%, Ni: 0.2 to 5%, Cu: 1.5% or less, W: 5% or less, Al: 1% or less, and Ca: 0.002% or less, with a remainder of Fe and unavoidable impurities, and wherein a critical passivation current density is 2.3 $mA/cm^2$ or less.

3. A ferritic stainless steel consisting of, in terms of mass %,

C: 0.001 to 0.02%, N: 0.001 to 0.02%, Si: 0.01 to 0.5%, Mn: 0.05 to 1%, P: 0.04% or less, S: 0.01% or less, Cr: 12 to 25%, Ti: 4(C+N) to 0.5%, B: 0.0002 to 0.0004%, Sn: 0.01 to 2%, and optionally, one or more of Sb: 0.005 to 1%, Nb: 0.02 to 1%, Ni: 0.2 to 5%, Cu: 1.5% or less, W: 5% or less, Al: 1% or less, and Ca: 0.002% or less, with a remainder of Fe and unavoidable impurities, and wherein a maximum value for corrosion depth is 600 μm or less which is measured by a corrosion testing method for automobile materials in conformity with JASO M609-91.

4. The ferritic stainless steel of claim 3, wherein a critical passivation current density is 2.3 $mA/cm^2$ or less.

* * * * *

UNITED STATES PATENT AND TRADEMARK OFFICE

CERTIFICATE OF CORRECTION

PATENT NO. : 8,470,237 B2
APPLICATION NO. : 12/226592
DATED : June 25, 2013
INVENTOR(S) : Hiraide et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 514 days.

Signed and Sealed this
Eighth Day of September, 2015

Michelle K. Lee

Michelle K. Lee
*Director of the United States Patent and Trademark Office*